US005832352A

United States Patent [19]

Pan et al.

[11] Patent Number: 5,832,352

[45] Date of Patent: Nov. 3, 1998

[54] METHOD AND APPARATUS FOR INCREASING THE MECHANICAL STRENGTH OF INTERMEDIATE IMAGES FOR LIQUID DEVELOPMENT IMAGE CONDITIONING

[75] Inventors: David H. Pan, Rochester; Thomas F. Cassetta, Elmira; Henry R. Till, East Rochester, all of N.Y.

[73] Assignee: Xerox Corporation, Stamford, Conn.

[21] Appl. No.: 874,591

[22] Filed: Jun. 13, 1997

[51] Int. Cl.[6] ..... G03G 15/16

[52] U.S. Cl. ..... 399/307; 399/308; 430/126

[58] Field of Search ..... 399/237, 249, 399/251, 302, 307, 308, 313; 430/117, 126

[56] References Cited

U.S. PATENT DOCUMENTS

| | | | |
|---|---|---|---|
| 5,028,964 | 7/1991 | Landa et al. | 399/390 |
| 5,200,285 | 4/1993 | Carrish | 430/45 |
| 5,410,392 | 4/1995 | Landa | 399/308 |
| 5,414,498 | 5/1995 | Buchan et al. | 399/239 |
| 5,426,491 | 6/1995 | Landa et al. | 399/237 |
| 5,493,373 | 2/1996 | Gundlach et al. | 399/302 |
| 5,558,970 | 9/1996 | Landa et al. | 430/126 |
| 5,689,786 | 11/1997 | Tokunaga et al. | 399/307 |

FOREIGN PATENT DOCUMENTS

| | | |
|---|---|---|
| 8-129310 | 5/1996 | Japan . |

*Primary Examiner*—Arthur T. Grimley
*Assistant Examiner*—Sophia S. Chen
*Attorney, Agent, or Firm*—Michelle Waites

[57] ABSTRACT

A method and apparatus for improving the quality of an image that has been developed by a liquid carrier is disclosed. Generally speaking, the invention includes conditioning an image that has been developed using a liquid carrier material to increase its strength. Thermal control is used to heat and cool the image in rapid succession, thereby increasing the cohesiveness of the solid particles contained in the liquid carrier.

13 Claims, 2 Drawing Sheets

METHOD AND APPARATUS FOR INCREASING THE MECHANICAL STRENGTH OF INTERMEDIATE IMAGES FOR LIQUID DEVELOPMENT IMAGE CONDITIONING

The present invention is directed to a method and apparatus for improving the quality of an image that is developed by a liquid carrier.

More specifically, the present invention is directed to a method and apparatus for increasing the strength of an intermediate image by using thermal control to heat and cool the image in rapid succession to increase image cohesiveness.

BACKGROUND OF THE INVENTION

Generally, the process of electrostatographic copying is initiated by exposing a light image of an original document to a substantially uniformly charged photoreceptive member. Exposing the charged photoreceptive member to a light image discharges its surface in areas which correspond to non-image areas in the original document while maintaining the charge in image areas. This selective discharging scheme results in the creation of an electrostatic latent image of the original document on the surface of the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a powder toner image on the photoreceptive member.

Alternatively, liquid developer materials comprising a liquid carrier material having toner particles dispersed therein have been utilized. In a process such as this, the developer material is applied to the latent image with the toner particles being attracted toward the image areas to form a liquid image. Regardless of the type of developer material employed, the toner particles of the developed image are subsequently transferred from the photoreceptive member to a copy sheet, either directly or by way of an intermediate transfer member. Once on the copy sheet, the image may be permanently affixed to provide a "hard copy" reproduction of the original document or file. The photoreceptive member is then cleaned to remove any charge and/or residual developing material from its surface in preparation for subsequent imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, in contradistinction to the light lens generated image systems which develop toner on the charged areas, knows as CAD, or "write white" systems. The subject invention applies to both such systems.

The use of liquid developer materials in imaging processes is well known. Likewise, the art of developing electrostatographic latent images formed on a photoconductive surface with liquid developer materials is also well known. Indeed, various types of liquid developing material development systems have heretofore been disclosed.

When using liquid toners, there is a need to remove the liquid carrier medium from the photoconductive surface after the toner has been applied thereto. This prevents the liquid carrier from being transferred from the photoreceptor to the paper or to the intermediate medium during image transfer. Removing the liquid carrier also allows it to be recovered for recycle and reuse in the developer system. This provides for additional cost savings in terms of printing supplies, and helps eliminate environmental and health concerns which result from disposal of excess liquid carrier medium.

One way to remove excess carrier fluid is to place a blotter roll in rotatable contact with the image while it resides on the intermediate substrate. Removal of carrier fluid results in an increase in solid particle content, thereby allowing for greater efficiency of the process of transferring the image from intermediate substrate to permanent media. The solid content of the toner particles can be further increased if a high pressure blotter roll is used. The most efficient conditioning of an image to increase the percentage of solids residing therein obviously requires removing carrier liquid while preventing the solid toner particles from leaving the image. Successful image conditioning also requires electrostatically compressing or compacting the toner particles in order to physically stabilize the image, and produce a clear, high resolution image. Each of these processes must be completed without disturbing the toner image. In addition, the carrier liquid removal device must also remain clean and free of toner particles so as to prevent it from thereafter contaminating a subsequent image with embedded toner particles.

Various techniques and devices have been devised for conditioning the liquid developer image by using blotter rolls or rollers to remove carrier liquid from the image as discussed above. Use of a high pressure blotter has shown to increase the solid particle content from approximately 25% to approximately 50%. While this approach has been quite effective, it requires the intermediate substrate to pass through a high pressure nip, which places a very high load on the intermediate substrate. Passing the substrate through a high pressure nip can cause a substantial amount of the image to be offset to the blotter surface when the input image reaches a certain thickness.

The following disclosures may be relevant to various aspects of the present invention:

U.S. Pat. No. 5,558,970 to Landa et al. issued Sep. 24, 1996 discloses a method of generating an image having enhanced cohesiveness by treating the image with heat, ultraviolet radiation or chemical agents prior to transfer of the image from a photoconductor.

U.S. Pat. No. 5,493,373 to Gundlach et al. issued Feb. 20, 1996 discloses a method and apparatus for printing using an intermediate member acting as a receptor for marking particles representing an image. The marking particles may be deposited directly or indirectly on the member, after which time the member is exposed, via an internal heat source, to an elevated temperature sufficient to cause the melting and coalescing of the marking particles. Subsequently, the intermediate member is advanced so as to place the tackified marking particles present on the outer surface thereof into intimate contact with the surface of a recording sheet.

U.S. Pat. No. 5,426,491 to Landa et al. issued Jun. 20, 1995 discloses an imaging process including the steps of forming an electrostatic image on a photoconductor surface, developing the electrostatic image with a liquid developer to form a developed image on the photoconductor surface, and transferring the developed image from the photoconductor surface to a final substrate. The cohesiveness of the developed image on the photoconductor surface is enhanced by the application of heat, ultraviolet radiation or a catalytic agent to the developed image on the photoconductor surface.

U.S. Pat. No. 5,028,964 to Landa et al. issued Jul. 2, 1991 discloses an apparatus for image transfer including an image bearing surface arranged to support a liquid toner image thereon, including image regions and background regions, means for removing pigmented toner particles from the vicinity of background regions defined on the image bearing surface, means for rigidizing the toner image at the image regions, and an intermediate transfer member for receiving the toner image from the image bearing surface after rigidization thereof, for transfer of the image to a substrate. Means for rigidizing the toner image at the image regions include electrifying a squeegee roller to a high voltage with a polarity that is the same as the polarity of the charged toner, and urging the squeegee roller against the image bearing surface.

All of the references cited herein are incorporated by reference for their teachings.

Accordingly, although known apparatus and processes are suitable for their intended purposes, a need remains for alternative methods to condition images that have been developed by liquid developer material to increase their solid content before transfer to an output copy sheet.

SUMMARY OF THE INVENTION

In accordance with the present invention, there is provided an apparatus for increasing the solid particle content of an image that has been developed using a liquid developer containing solid toner particles residing in a liquid carrier material, which includes: a transfer system to move an image developed by the liquid developer to a substrate; a roller arrangement for transporting a substrate along a path, said substrate capable of supporting the liquid developer material; a heat source, located in said path, for applying heat to the liquid developed image, thereby causing the solid toner particles to melt; and a cooling source, located in said path in a downward direction from said heating source, for cooling said liquid developed image, thereby causing said melted toner particles to re-solidify.

In accordance with another aspect of the invention, there is provided a method of increasing the solid particle content of an image that has been developed with a liquid developer containing solid toner particles residing in a liquid carrier material, which includes: transferring an image that has been developed by the liquid developer to a substrate; transporting said substrate with said liquid developed image thereon along a path; heating said image, thereby causing the solid toner particles to melt; and immediately cooling said image, thereby causing said melted toner particles to re-solidify.

In accordance with yet another aspect of the present invention there is provided an apparatus for increasing the solid particle content of an image that has been developed using a liquid developer containing solid toner particles residing in a liquid carrier material, including: means for transferring the image to a substrate; means for transporting said substrate with said liquid developed image thereon along a path; means for heating said image, thereby causing the solid toner particles to melt; and means for immediately cooling said image, thereby causing said melted toner particles to re-solidify.

Liquid developers have many advantages, and often produce images of higher quality than images formed with dry toners. For example, images developed with liquid developers can be made to adhere to paper without a fixing or fusing step, thereby eliminating a requirement to include a resin in the liquid developer for fusing purposes. In addition, the toner particles can be made to be very small without resulting in problems often associated with small particle powder toners, such as airborne contamination which can adversely affect machine reliability and can create potential health hazards. Development with liquid developers in full color imaging processes also has many advantages, including, among others, production of a texturally attractive output document due to minimal multilayer toner height build-up (whereas full color images developed with dry toners often exhibit substantial height buildup of the image in regions where color areas overlap). In addition, full color imaging with liquid developers is economically attractive, particularly if surplus liquid carrier containing the toner particles can be economically recovered without cross contamination of colorants. Further, full color prints made with liquid developers can be processed to a substantially uniform finish, whereas uniformity of finish is difficult to achieve with powder toners due to variations in the toner pile height as well as a need for thermal fusion, among other factors.

BRIEF DESCRIPTION OF THE DRAWINGS

Other features and advantages of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

The present invention is directed to a method and apparatus for improving the quality of an image that is developed by a liquid carrier. More specifically, the present invention is directed to a method and apparatus for increasing the strength of an intermediate image by using thermal control to heat and cool the image in rapid succession to increase image cohesiveness.

Figure 1:
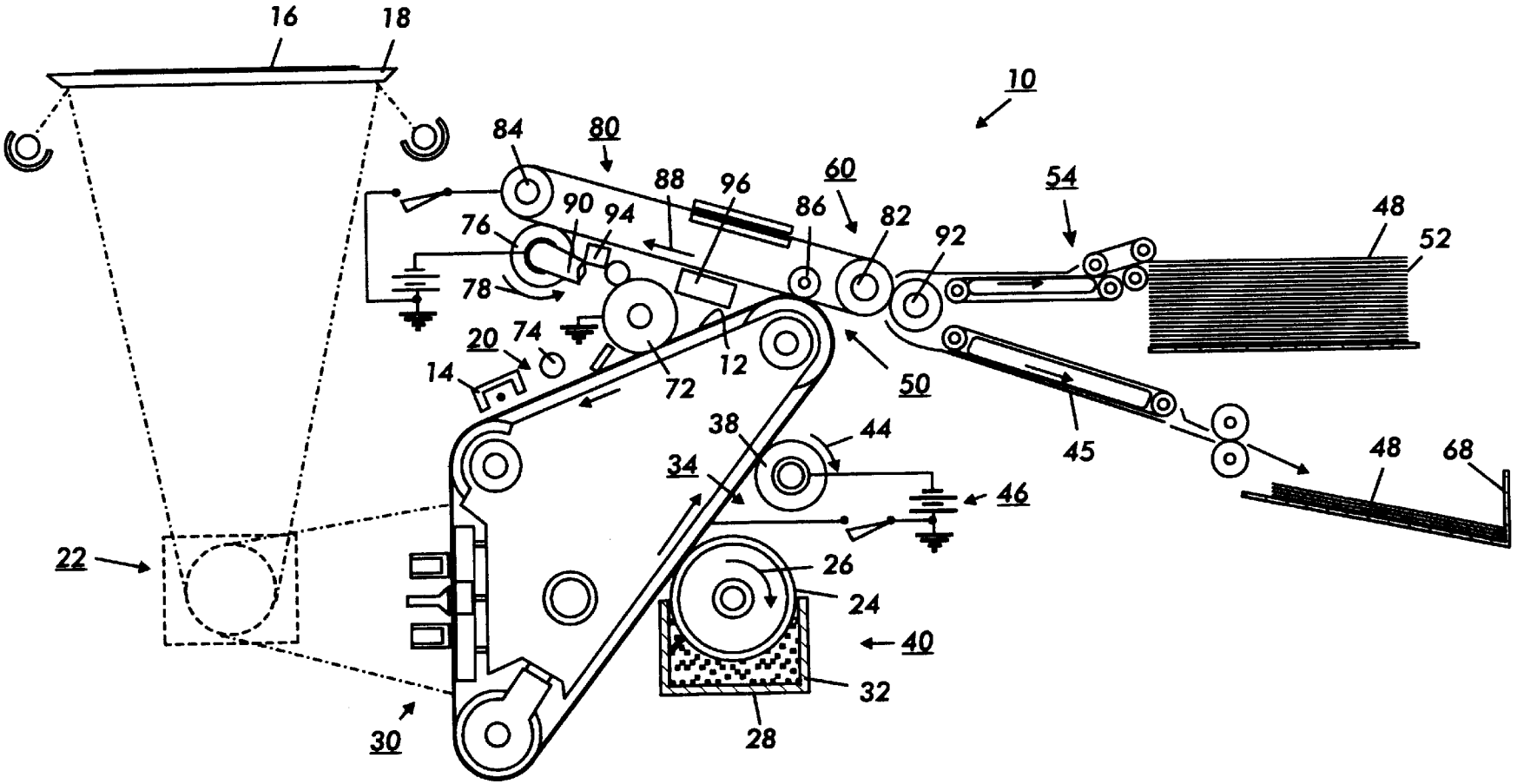
FIG. 1 contains a schematic illustration of a portion of an electrophotographic printing machine which uses an intermediate transfer belt to complete liquid image development.

Referring now to the drawings where the showings are for the purpose of describing an embodiment of the invention and not for limiting same, in FIG. 1, reproduction machine 10 employs belt 12 having a photoconductive surface deposited on a conductive substrate. Initially, belt 12 passes through charging station 20. At charging station 20, a corona generating device 14 charges the photoconductive surface of belt 12 to a relatively high, substantially uniform potential.

Once the photoconductive surface of belt 12 is charged, the charged portion is advanced to exposure station 30. At exposure station 30, an original document 16 is placed upon a transparent support platen 18. An illumination assembly, indicated generally by the reference numeral 22, illuminates the original document 16 on platen 18 to produce image rays corresponding to the document information areas. The image rays are projected by means of an optical system onto the charged portion of the photoconductive surface. The light image dissipates the charge in selected areas to record an electrostatic latent image 2 (not shown) on the photoconductive surface corresponding to the original document informational areas.

After electrostatic latent image 2 has been recorded, belt 12 advances it to development station 40. At development station 40, roller 24, rotating in the direction of arrow 26, advances a liquid developer material 28 from the chamber of housing 32 to development zone 34. An electrode 36 positioned before the entrance to development zone 34 is electrically biased to generate an AC field just prior to the entrance to development zone 34 so as to disperse the toner particles substantially uniformly throughout the carrier liquid. The toner particles, disseminated through the carrier liquid, pass by electrophoresis to electrostatic latent image 2. The charge of the toner particles is opposite in polarity to the charge on the photoconductive surface.

Development station 40 includes image conditioning roller 38. Roller 38 encounters the developed image 4 on belt 12 and conditions the image by removing and reducing liquid content of the image, while inhibiting and preventing the solid toner particles from leaving the image. The roller 38 also conditions the image by electrostatically compacting the toner particles of the image. Thus, an increase in percent solids is achieved in the developed image, thereby improving the quality of the final image.

Roller 38 is placed in pressure contact against the blotter roller, to squeeze the absorbed carrier liquid from the blotter roller for deposit into a receptacle. An electrical potential is applied to roller 38 from a high voltage bias supply 46. The electric field, having the same sign polarity as the toner particles, repels the toner particles of the image and inhibits their entry to the roller 38.

In operation, roller 38 rotates in direction 44 to encounter a "wet" image on belt 12. The body of roller 38 absorbs excess liquid from the surface of the image through the skin covering, while conditioning the image on belt 12. Roller 38, discharged of excess liquid, continues to rotate in direction 44 to provide a continuous absorption of liquid from the image on belt 12.

At transfer station 50, the developed liquid image 4 is electrostatically transferred to an intermediate member or belt indicated generally by the reference numeral 80. Intermediate belt 80 is entrained about spaced rollers 82 and 84. Intermediate belt 80 moves in the direction of arrow 88. Bias transfer roller 86 imposes intermediate belt 80 against belt 12 to assure image transfer to the intermediate belt 80.

The thermal control apparatus of the present invention is represented generally by reference numeral 96, the details of which will be described below. Briefly, the invention applies heat and cooling to developed image 4 in rapid sequence, thereby increasing the solid particle content of the liquid. Heat is first applied to melt the solid particles, allowing them to become meshed together in the surrounding fluid. Subsequent cooling causes the melted particles to strengthen their interparticle bonds by taking on a solid form. Generating a solid developed image facilitates transfer of an accurate reproduction of the original image to hardcopy output. Once this thermal treatment has been completed, developed image 4 moves past High Solid Image Conditioning (HSIC) 94, which increases the solid particle content of a contacting image by exerting a high pressure on the image. The magnitude of the pressure applied is dependent on the characteristics of the toner contained in the liquid developer material. For example, successful results have been achieved by exerting a pressure of 250 psi on a liquid containing Mark II Liquid toner. Mark II Liquid toner is described in detail in U.S. Pat. No. 5,604,075 to Larson et al. issued Feb. 18, 1997, and in U.S. Pat. No. 5,559,558 to Larson et al. issued Sep. 24, 1997. The contents of these references are hereby incorporated by reference. It should be kept in mind that Mark II Liquid toner is merely one example of a toner that may be transported in a liquid carrier medium, and the invention is not limited to this embodiment.

In this particular embodiment of the machine, an additional conditioning roller shown as blotter roller 76, conditions developed image 4 on belt 80 by electrostatically compressing the image, and additionally reducing the liquid content of the image, while preventing toner particles from departing from the image.

In operation, roller 76 rotates in direction 78 to impose against the image on belt 80. The body of roller 76 absorbs liquid from the surface of the image. The absorbed liquid permeates through roller 76 and into the inner hollow cavity, where a vacuum system 90 draws the liquid from the roller 76 into a liquid receptacle (not shown) or some other location which will allow for either disposal or recirculation of the carrier liquid. Roller 76, discharged of excess liquid, continues to rotate in direction 78 to provide a continuous absorption of liquid from images on transfer belt 80.

Belt 80 then advances the developed image to transfer/fusing station 60. At transfer/fusing station 60, a copy sheet 48 is advanced from stack 52 by a sheet transport mechanism, indicated generally by the reference numeral 54. Developed image 4 on the photoconductive surface of belt 80 is attracted to copy sheet 48, and is simultaneously heated and fused to the sheet by heat from roller 82, for example. Pressure may be applied to the surface of the image such as by roll 92 to assist in transferring the image from belt 80 to sheet 48. After transfer, conveyor belt 45 moves the copy sheet 48 to the discharge output tray 68.

After developed image 4 is transferred to copy sheet 48, residual liquid developer material remains adhering to the photoconductive surface of belt 12. A cleaning roller 72 formed of any appropriate synthetic resin, is driven in a direction opposite to the direction of movement of belt 12 to scrub the photoconductive surface clean. It is understood, however, that a number of photoconductor cleaning means exist in the art, any of which would be suitable for use with the present invention. Any residual charge left on the photoconductive surface is extinguished by flooding the photoconductive surface with light from lamps 74. Although the apparatus shown in FIG. 1 shows only a single roller 76, multiple roller stations can be utilized in conjunction with a single belt or with the transfer of multiple images to an intermediate belt 80.

Figure 2:
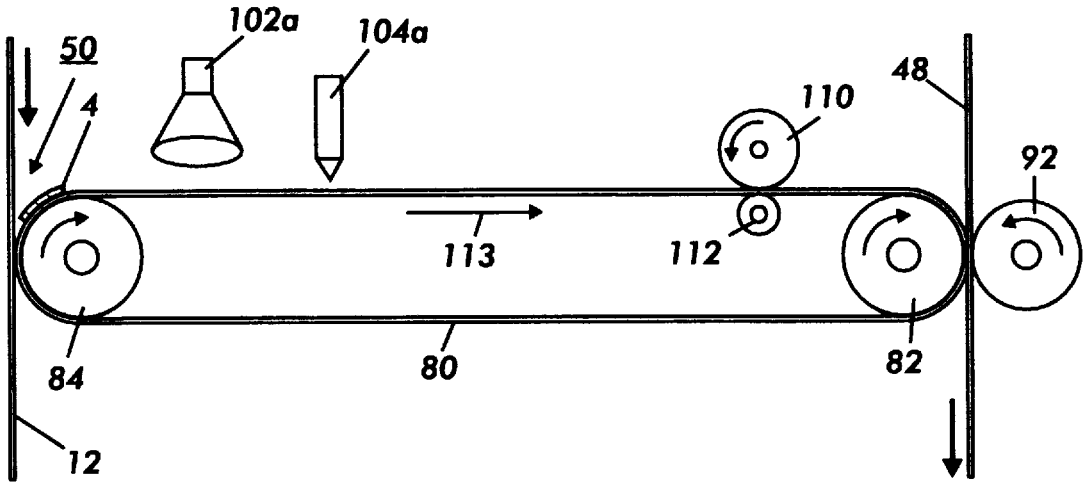
FIG. 2 contains a detailed illustration of one embodiment of the present invention, depicting one example of a heat source and a cooling source that may be used to practice the present invention.

Referring now to FIG. 2, the present invention controls the forces within the developer material such that the cohesiveness of developed image 4 is sufficient to resist the force of attraction that is applied by the blotter. As indicated above, developed image 4 is transferred from photoreceptor 12 to belt 80 at transfer station 50. One embodiment includes transport of belt 80 with developed image 4 thereon, via rollers 82 and 84 through a path in the direction indicated by arrow 113. Developed image 4 is first heated by a heat source to provide a melting transition to the toner particles, particularly coalescing toner particles.

Figure 3:
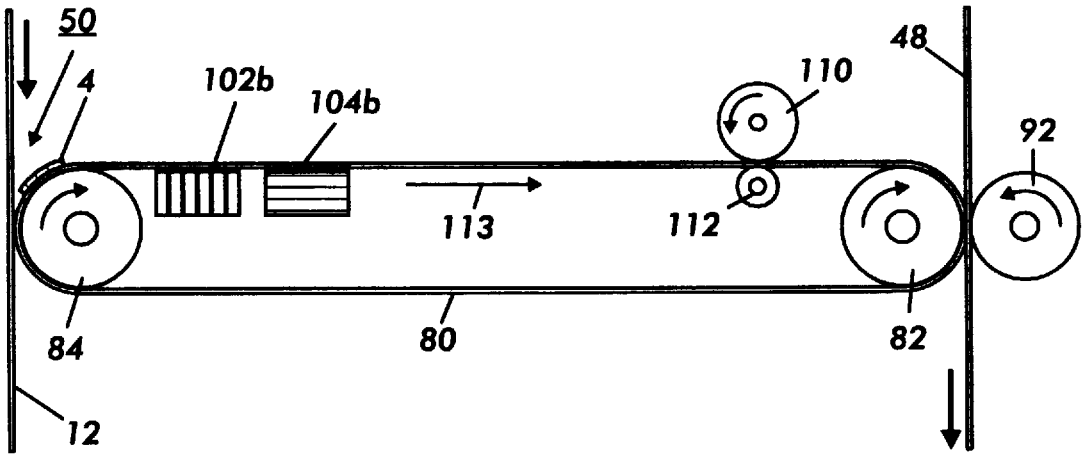
FIG. 3 contains a detailed illustration of a second embodiment of the present invention, depicting another example of a heat source and a cooling source that may be used to practice the present invention.

In one embodiment, the heat source may be a heat lamp 102*a* as shown in FIG. 2. Alternatively, the heat source may be a heat exchanger 102*b*, as depicted in FIG. 3. The image should be heated to its transition point, thereby allowing the chemical bonds within the solid toner particles to break down. Therefore, the temperature to which the image should be heated is dependent upon the type of toner particles that are present in the carrier medium. In the case of Mark II toner described above, the image must typically be heated to between 75° C. and 100° C.

Most often heating by lamp 102*a* or exchanger 102*b* will immediately followed by cooling. Cooling is usually required because most types of photoreceptors 12 cannot sustain the required electrostatic charge if its surface temperature is allowed to become too high. If the photoreceptor used in the reproduction system can sustain a high surface temperature, the cooling step will not be required. In those cases where a high temperature photoreceptor is not available, typical methods of cooling the image include the use of air knife 104*a*, shown in FIG. 2, and cold air exchanger 104*b*, illustrated in FIG. 3. It should be noted that practice of the invention does not require heat lamp 102*a* and air knife 104*a* to be used together within a single system, nor does it require heat exchanger 102*b* and cold air exchanger 104*b* to be used together. Those skilled in the art will recognize that heat lamp 102*a* and cold air exchanger 104*b* may be used in a single system, as may heat exchanger 102*b* and air knife 104*a*. In fact, those skilled in the art will recognize that numerous other heating and cooling apparatus are available, and may successfully be used, and the invention is not limited to these embodiments.

In any event, cooling of the image immediately after it is heated causes the melted image to re-solidify, enabling the mechanical strength between the particles to be sufficient to overcome the force of adhesion between the blotter and the image, thereby eliminating image offset. The image must be cooled to the point that it will transition from liquid to solid form. As was the case with heating of the image, the temperature to which the image must be cooled is dependent upon the type of toner particles that are present in the carrier medium. Continuing with the example of Mark II toner, typical temperatures will range from room temperature (approximately 21°) to about 60° C. The exact amount of cooling required for re-solidification of the melted image will be dependent upon the point at which image cohesion becomes stronger than the attraction between the image and the blotter. This will be dependent upon the mechanical durability and reliability of the blotter material at elevated temperatures as well as the heat transfer requirements of the imaging system. Rolls 110 and 112 can be used to apply pressure to the surface of the cooled image 4 to further increase its strength if desired.

It is, therefore, apparent that there has been provided in accordance with the present invention, a method and apparatus for increasing the mechanical strength of a developed liquid image that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for increasing the solid particle content of an image that has been developed using a liquid developer containing solid toner particles residing in a liquid carrier material, comprising:

a) a transfer system to move an image developed by the liquid developer from a liquid developed image bearing member to an intermediate transfer belt;

b) a roller arrangement for transporting said intermediate transfer belt along a path, said intermediate transfer belt capable of supporting the liquid developer material;

c) a heating source, located in said path, for heating said liquid developed image to at least a solid to liquid transition temperature of said toner particles, thereby causing the solid toner particles to melt wherein said solid to liquid transition temperature is between 80° C. and 100° C.; and d) a cooling source, located in said path in a downward direction from said heating source, for cooling said liquid developed image, thereby causing said melted toner particles to re-solidify.

2. An apparatus as claimed in claim 1 wherein said heating source is a heat lamp.

3. An apparatus as claimed in claim 1 wherein said heat source is a heat exchanger.

4. An apparatus as claimed in claim 1 wherein said cooling source is an air knife.

5. An apparatus as claimed in claim 1 wherein said cooling source is a cold air exchanger.

6. The apparatus of claim 1 wherein said image is cooled to at least a liquid to solid transition temperature for said melted toner particles.

7. The apparatus of claim 6 wherein said liquid to solid transition temperature is between 21° C. and 60° C.

8. A method of increasing the solid particle content of an image that has been developed with a liquid developer containing solid toner particles residing in a liquid carrier material, comprising:

a) transferring an image that has been developed by the liquid developer from a liquid developed image bearing member to an intermediate transfer belt;

b) transporting said intermediate transfer belt with said liquid developed image thereon along a path;

c) heating said liquid developed image to at least a solid to liquid transition temperature of said toner particles, thereby causing the solid toner particles to melt wherein said solid to liquid transition temperature is between 80° C. and 100° C.; and d) immediately cooling said liquid developed image, thereby causing said melted toner particles to re-solidify.

9. A method as claimed in claim 8 wherein said cooling step further comprises decreasing a temperature of said image to at least a liquid to solid transition temperature for said melted toner particles.

10. A method as claimed in claim 9 wherein said liquid to solid transition temperature is between 21° C. and 60° C.

11. An apparatus for increasing the solid particle content of an image that has been developed using a liquid developer containing solid toner particles residing in a liquid carrier material, comprising:

a) means for transferring the liquid developed image from a liquid developed image bearing member to an intermediate transfer belt;

b) means for transporting said intermediate transfer belt with said liquid developed image thereon along a path;

c) means for heating said liquid developed image to at least a solid to liquid transition temperature said solid toner particles, thereby causing the solid toner particles to melt, wherein said solid to liquid transition temperature is between 80° C. and 100° C.; and d) means for immediately cooling said liquid developed image, thereby causing said melted toner particles to re-solidify.

12. An apparatus as claimed in claim 11 wherein said cooling means further comprises decreasing a temperature of said image to a liquid to at least a solid transition temperature for said melted toner particles.

13. An apparatus as claimed in claim 12 wherein said liquid to solid transition temperature is between 21° C. and 60° C.

* * * * *